US011136531B2

(12) United States Patent
Maharaj et al.

(10) Patent No.: US 11,136,531 B2
(45) Date of Patent: Oct. 5, 2021

(54) CLEANING SYSTEM FOR A PRINTING PRESS RECIRCULATION SYSTEM

(71) Applicant: Allied Pressroom Products, Monroe, NC (US)

(72) Inventors: Telluckram Maharaj, Ft. Lauderdale, FL (US); Sydney Sures, Charlotte, NC (US)

(73) Assignee: Allied Pressroom Products, Monroe, NC (US)

( * ) Notice: Subject to any disclaimer, the term of this patent is extended or adjusted under 35 U.S.C. 154(b) by 0 days.

(21) Appl. No.: 16/659,905

(22) Filed: Oct. 22, 2019

(65) Prior Publication Data

US 2020/0123471 A1 Apr. 23, 2020

Related U.S. Application Data

(60) Provisional application No. 62/748,751, filed on Oct. 22, 2018.

(51) Int. Cl.

| | |
|---|---|
| ***C11D 3/08*** | (2006.01) |
| ***B41N 3/00*** | (2006.01) |
| ***C11D 3/06*** | (2006.01) |
| ***C11D 3/00*** | (2006.01) |
| ***C11D 11/00*** | (2006.01) |
| ***C11D 3/10*** | (2006.01) |
| ***C11D 3/20*** | (2006.01) |

(52) U.S. Cl.

CPC ..... *C11D 3/08* (2013.01); *B41N 3/006* (2013.01); *C11D 3/0026* (2013.01); *C11D 3/06* (2013.01); *C11D 3/10* (2013.01); *C11D 3/2082* (2013.01); *C11D 11/0064* (2013.01); *B41P 2235/50* (2013.01)

(58) Field of Classification Search

CPC . C11D 11/0011; C11D 11/0041; C11D 1/345; C11D 3/0026; C11D 3/06; C11D 3/08; C11D 3/10; C11D 3/2075; C11D 3/2082; B41N 3/006

See application file for complete search history.

(56) References Cited

U.S. PATENT DOCUMENTS

| | | | | |
|---|---|---|---|---|
| 5,993,562 | A * | 11/1999 | Roelofs | B08B 9/032 134/22.13 |
| 6,631,682 | B2 | 10/2003 | Maharaj | |
| 2010/0293723 | A1 * | 11/2010 | Racette | C11D 1/345 8/142 |
| 2011/0152156 | A1 * | 6/2011 | Sauter | C11D 3/323 510/234 |
| 2019/0072854 | A1 * | 3/2019 | Moriame | G03F 7/039 |

* cited by examiner

*Primary Examiner* — John R Hardee
(74) *Attorney, Agent, or Firm* — Burr & Forman LLP

(57) ABSTRACT

A cleaning system is provided for a printing press recirculation system, in which the cleaning system generates a plurality of bubbles within a fountain solution of the printing press recirculation system. The cleaning system includes (i) a first composition comprising a solid blend including (a) a first alkaline cleaning agent having a first alkaline strength, (b) a detergent salt, (c) a non-foaming emulsifying agent, and (d) a second alkaline cleaning agent having a second alkaline strength, in which the first alkaline strength is greater than the second alkaline strength; (ii) a second composition comprising one or more organic acids. Also provided are methods of cleaning a printing press recirculation system.

20 Claims, No Drawings

CLEANING SYSTEM FOR A PRINTING PRESS RECIRCULATION SYSTEM

CROSS-REFERENCE TO RELATED APPLICATIONS

This application claims priority under 35 U.S.C. § 119(e) to U.S. Provisional Application No. 62/748,751, filed Oct. 22, 2018, which is expressly incorporated by reference herein in its entirety.

TECHNICAL FIELD

Embodiments of the presently-disclosed invention relate generally to cleaning systems (e.g., bubble-forming cleaning systems) for printing press (e.g. a lithographic press) recirculation systems, in which the cleaning systems include (i) a first composition having, at least, a blend of at least two alkaline cleaning agents and (ii) a second composition including at least one acid. Embodiments of the presently-disclosed invention also provide methods of cleaning printing press recirculation systems.

BACKGROUND

In lithographic printing, ink is fed onto the printing plate through a series of ink rollers and adheres on the image or printing areas of the plate. Dampening or fountain solution, which is water based, is fed onto the plate via a recirculation system from a holding reservoir. The holding reservoir feeds the dampening solution to the printing plate via a series of pipes and rollers. On the printing plate, the fountain solution functions to keep the non-image or non-printing surface of the plate clean and free of ink.

Since the recirculating systems allows the fountain solution to be continuously recirculated to the plate while the press is operating, it is a normal consequence of the printing process that ink, paper debris, calcium deposits, mold and fungi, and other contamination accumulate in the system. Periodically this must be cleaned and re-filled with fresh fountain solution to keep the press operating at a desirable or optimum level.

Several products exist in the industry to clean printing press recirculating systems. One typical methodology on which these cleaners are premised involves draining the contaminated fountain solution from the recirculating system, refilling with clean water, adding either a liquid or powdered detergent mixture and allowing it to recirculate within the system. Next, the detergent solution is drained, the system is flushed with water, and then re-filled with fresh fountain solution.

A second type of methodology utilizes a two-step product or system in which a detergent powder is added directly into the contaminated fountain solution without draining and followed by recirculating the system. After recirculation, a neutralizer powder is added to the detergent-containing fountain solution and allowing the contents to recirculate. After recirculation of the neutralization fountain solution, the recirculation system is drained and flushed with water before refilling the recirculation system with fresh fountain solution.

An additional methodology involves adding an aqueous detergent solution followed by recirculation and subsequently adding an aqueous solution of an acidic neutralizer to the recirculation system. The neutralized fountain solution is allowed to recirculate within the recirculation system then drained. After draining, the recirculation system is flushed and re-filled with fresh fountain solution.

Each of these methodologies have several inherent shortcomings. For instance, each of these processes are often repeated more than once to adequately clean the recirculating system. Additionally, alkaline detergents are commonly used in the first type of methodologies. Strong bases such as alkali metal hydroxides can be used but are not effective emulsifiers of the soils present in recirculating systems. High pH detergents, such as silicate and metasilicate salts and carbonate salts, are good cleaners; however, the highly alkaline nature of these detergents in the cleaners result in excessive undesirable foaming as it recirculates in the system.

With respect to the second type of methodologies employing powdered detergents, the detergents are added directly to the recirculation system. They can also be pre-dissolved before adding to the recirculation tank. This requires an additional step for powdered systems and larger volumes of hazardous liquids for liquid cleaners. Without the pre-dissolution step, there is a tendency for the detergent to undesirably become adsorbed on to the walls of the system.

Even with liquid cleaners where the detergent is provided in a solution form, the current methodology based on the use of strong detergents as cleaners, results in the re-deposition of soil material in the lines and at the bottom of the fountain solution tank that are difficult to remove even with repeated flushing with clean water before re-filling with fresh fountain solution. Together with the foaming issue, the adsorption of the detergent to the walls of the system, and the re-deposition of emulsified soil leads to increased down time of the printing press.

Additionally, none of the existing methodologies addresses the contamination of the recirculation systems with calcium deposits from the paper and ink, which occur as a natural consequence of the printing process. The accumulation of insoluble calcium salts affects the performance and longevity of the fresh fountain solution that is used to re-fill the system after cleaning. In addition, calcium build-up within the lines and pipes of the system eventually leads to restriction of the flow of the fountain solution to the printing press itself.

Accordingly, there still remains a need in the art for a more efficient means (e.g., a cleaning system and/or cleaning method) to clean a printing press recirculating system, which provides one or more of the following: (1) addresses the prior art shortcoming of excessive foaming of the cleaner itself under the pressure of the recirculation pump; (2) reduces the time required to clean a printing press recirculating system; (3) eliminates or mitigates the adsorption of detergent and the re-deposition of the emulsified soil in the recirculation system; and (4) reduce or eliminate the calcium contamination of the recirculation system.

SUMMARY OF INVENTION

One or more embodiments of the invention may address one or more of the aforementioned problems. Certain embodiments according to the invention provide cleaning systems for a printing press recirculation system including at least two separate compositions (e.g., two powdered compositions). In accordance with certain embodiments of the invention, the cleaning system includes a first composition comprising a solid blend (e.g., dry blended powdered form, tablet form, etc.) including (a) a first alkaline cleaning agent having a first alkaline strength, (b) a detergent salt, (c) a non-foaming emulsifying or wetting agent, and (d) a second alkaline cleaning agent having a second alkaline strength. In accordance with certain embodiments of the invention, the first alkaline strength is greater than the second alkaline strength. The cleaning systems, in accordance with certain embodiments of the invention, also comprise a second composition (e.g., dry blended powdered form, tablet form, etc.) comprising one or more organic acids (e.g., one or more organic acids in dry form).

In another aspect, the present disclosure provides methods of cleaning a printing press recirculation system, in which the recirculation system includes a recirculation tank and a plurality of recirculation lines with a fountain solution contained within the recirculation system. In accordance with certain embodiments of the invention, the methods of cleaning a printing press recirculation system may comprise the following steps: (i) administering a first composition into the printing press recirculation system, wherein the first composition comprises an alkaline composition; (ii) recirculating the fountain solution through the printing press recirculation system subsequently and/or concurrently with step (i); (iii) administering a second composition comprising at least one acid into the printing press recirculation system in an amount sufficient to form an acidic fountain solution subsequent to step (ii); (iv) recirculating the acid fountain solution subsequently and/or concurrently with step (iii); and (v) allowing the first composition and second composition to react and form a plurality of bubbles within the acidic fountain solution.

DETAILED DESCRIPTION

The invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The term "alkalinity", as used herein, may refer to a material's ability in water to buffer or resist changes in pH upon addition of an acid. In this regard, pH is a measurement of the strength of an acid or base, while alkalinity is a measurement of the ability to neutralize an acid (e.g., buffer capacity) in an aqueous composition (e.g., aqueous solution).

The term "alkaline strength", as used herein, may refer to a materials buffering capacity, for example, when added to an aqueous composition (e.g., aqueous solution). The greater the alkaline strength associated with a material or composition, for example, the higher the buffering capacity against pH changes. In this regard, a material or composition having a greater alkaline strength provides a greater buffering capacity then a comparative material or composition having a lower alkaline strength. In accordance with certain embodiments of the invention, the alkaline strength may be evaluated by the resulting pH of a 1% (w/w) aqueous solution of a material at 20° C. By way of example only, a 1% (w/w) aqueous solution of sodium metasilicate pentahydrate has a pH of about 12.5, a 1% (w/w) aqueous solution of sodium carbonate has a pH of about 11.4, and a 1% (w/w) aqueous solution of sodium bicarbonate has a pH of about 8.4. In this regard, sodium metasilicate pentahydrate is considered to have a higher or stronger alkaline strength than sodium carbonate, and sodium carbonate is considered to have a higher or stronger alkaline strength than sodium bicarbonate.

The presently-disclosed invention provides cleaner systems (e.g., non-aqueous cleaning systems) for printing press recirculation systems including at least two separate compositions (e.g., dry powdered blends), in which a first composition includes at least two different alkaline cleaning agents and a second composition including at least one acid (e.g., one or more organic acids). In this regard, the constituents of the first and second compositions are selected such that at least a portion of the first and second compositions (or components thereof) react in a fountain solution housed or contained within the recirculation system to produce a gas (e.g., carbon dioxide) in the form of a plurality bubbles. In this regard, the plurality of bubbles may be formed, at least or mostly, within the body of the fountain solution as opposed to predominantly at the surface (e.g., interface exposed to the local atmosphere or empty tank head) of the fountain solution in a recirculation tank that may be characterized as undesirable foam. In accordance with certain embodiments of the invention, the cleaner systems may comprise a relatively low our lower concentration of highly alkaline cleaning agent(s) (e.g., alkaline detergent) as compared to traditional cleaning systems to minimize foaming in the recirculation system. The relatively low our lower concentration of highly alkaline cleaning agent(s) (e.g., alkaline detergent) may be provided concomitantly with a mildly alkaline (e.g., less alkaline strength as compared to the highly alkaline cleaning agent), highly soluble, cleaning agent (e.g., alkaline detergent). In accordance with certain embodiments of the invention, the mildly alkaline cleaning agent is selected such that when neutralized by an acid (e.g., an organic acid) a production of an abundance of minute bubbles are realized. In this regard, the minute bubbles may facilitate the loosening and dislodging of soil and calcium deposits adhering to the walls of the recirculation system, which makes the contamination easier to flush out of the system. Beneficially, this approach ensures less time for flushing of the recirculation system and provides a more thorough cleaning. In accordance with certain embodiments of the invention, the second composition of the cleaning system may comprise a composition selected or configured to not only neutralize the alkalinity of the first composition, but also chosen to maximize the bubbling effect when added to the recirculation system. In accordance with certain embodiments of the invention, the cleaning system comprises a composition (e.g., second composition including one or more organic acids) that dissolves, dislodges, and keeps in solution or suspension calcium deposits usually found building-up in the recirculating system as the printing press operates. By dissolving and/or suspending these deposits, they become easy to flush out. In accordance with certain embodiments of the invention, the cleaning system is easily or readily dissolvable in the recirculating system liquid (e.g., fountain solution), making it possible to add the compositions of the cleaner system as powders to thereby eliminate the need to predissolve the cleaning agents(s) (e.g., detergent(s)) and reduce the time needed for cleaning of the recirculation system.

Certain embodiments according to the invention provide cleaning systems for a printing press recirculation system including at least two separate compositions (e.g., two powdered compositions). In accordance with certain embodiments of the invention, the cleaning system includes a combination of one or more of the following: (i) a first alkaline cleaning agent having a first alkaline strength; (ii) a detergent salt; (iii) an emulsifying or wetting agent (e.g., non-foaming); (iv) a second alkaline cleaning agent having a second alkaline strength that is less than the first alkaline strength; and (v) one or more acids (e.g., one or more organic acids in dry form). In accordance with certain embodiments of the invention, ingredients (i) through (v) may be provided in two or more separate and distinct compositions (e.g., separate dry or solid compositions). For example, ingredients (i) through (iv) may be formulated together as a single, first composition and ingredient (v) may be formulated as a separate composition. However, cleaning systems in accordance with certain embodiments of the invention may include ingredients (i) through (v) in more than two separate and distinct compositions (e.g., 3, 4, or 5 separate and distinct compositions). Certain embodiments according to the invention also provide a cleaning system formulation including ingredients (i) through (iv).

Certain embodiments according to the invention provide cleaning systems for a printing press recirculation system including at least two separate compositions (e.g., two powdered compositions). In accordance with certain embodiments of the invention, the cleaning system includes a first composition comprising a solid blend (e.g., dry blended powdered form, tablet form, etc.) including (a) a first alkaline cleaning agent having a first alkaline strength, (b) a detergent salt, (c) a non-foaming emulsifying or wetting agent, and (d) a second alkaline cleaning agent having a second alkaline strength. In accordance with certain embodiments of the invention, the first alkaline strength is greater than the second alkaline strength. The cleaning systems, in accordance with certain embodiments of the invention, also comprise a second composition (e.g., dry blended powdered form, tablet form, etc.) comprising one or more organic acids (e.g., one or more organic acids in dry form).

In accordance with certain embodiments of the invention, the first composition of the cleaning system may comprise from about 1 to about 50 weight percent of the first alkaline cleaning agent, such as from at least about any of the following: 1, 2, 4, 6, 8, 10, 12, 14, 15, and 20 weight percent and/or at most about 50, 45, 40, 35, 30, 25, 20, 15, 12, 10, 8, and 6 weight percent. As noted above, the first alkaline cleaning agent may be considered a strongly alkaline cleaning agent in comparison to the second alkaline cleaning agent. In this regard, the first alkaline cleaning agent may be selected or structured to remove fountain solution and ink residues together with paper contamination. In accordance with certain embodiments of the invention, alkaline cleaners such as alkali metal hydroxides with high base dissociation constants, such as sodium and potassium hydroxides, may be used. Such alkali metal hydroxides with high base dissociation constants, however, tend to be corrosive and are not particularly effective emulsifiers of soil. In this regard, the first alkaline cleaning agent (e.g., the strongly alkaline cleaning agent) according to certain embodiments of the invention comprises a silicate compound, such as a sodium metasilicate (e.g., sodium metasilicate pentahydrate). As noted above and by way of reference, a 1% (w/w) aqueous solution of sodium metasilicate pentahydrate has a pH of about 12.5. In accordance with certain embodiments of the invention, other water soluble silicate compounds, or other detergents with other operating pH ranges, may additionally or alternatively be employed.

In accordance with certain embodiments of the invention, a first 1% solution of the first alkaline cleaning agent at 20° C. has a first pH value and a second 1% solution of the second alkaline cleaning agent at 20° C. has a second pH, in which the first pH is larger than the second pH. For example, the first pH may comprise from 11-14, such as at least about any of the following: 11, 12, 12.5, 13, and 13.5 and/or at most about 14, 13.8, 13.6, 13, 4, 13.2, 13, 12.8, and 12.6.

In accordance with certain embodiments of the invention, the first composition of the cleaning system may comprise from about 1 to about 50 weight percent of the detergent salt, such as from at least about any of the following: 1, 2, 4, 6, 8, 10, 12, 14, 15, and 20 weight percent and/or at most about 50, 45, 40, 35, 30, 25, 20, 15, 12, 10, 8, and 6 weight percent. The detergent salt, for example, functions to suspend and chelate insoluble metal salts normally found in inks and increase the effectiveness of the alkaline cleaning agents. In accordance with certain embodiments of the invention, the detergent salt comprises, for example, a phosphate salt, such as sodium tripolyphosphate. Additionally or alternatively, other detergent salts may be used.

The first composition, in accordance with certain embodiments of the invention, comprises from about 1 to about 50 weight percent of the non-foaming emulsifying or wetting agent, such as from at least about any of the following: 1, 2, 4, 6, 8, 10, 12, 14, 15, and 20 weight percent and/or at most about 50, 45, 40, 35, 30, 25, 20, 15, 12, 10, 8, and 6 weight percent. The emulsifying or wetting agent facilitates the removal of oily residues in the recirculation system, such as inks and ink oils. In accordance with certain embodiments of the invention, the emulsifying or wetting agent comprises an anionic surfactant, such as an alkyaryl sulfonate. One particular example of an alkyaryl sulfonate is sodium xylene sulfonate commercially available from Stepan Company under the brand name STEPANATE SXS-93 in powder form, which has high detergency and negligible foaming characteristics compared with other detergents, although other powdered emulsifying or wetting agents may be used in accordance with certain embodiments of the invention.

The first composition, in accordance with certain embodiments of the invention, may comprises from about 20 to about 85 weight percent of the second alkaline cleaning agent, such as from at least about any of the following: 20, 25, 30, 35, 40, and 45 weight percent and/or at most about 85, 80, 75, 70, 65, 60, 55, 50, 45, 40, and 35 weight percent. As noted above, the second alkaline cleaning agent may be considered a mildly alkaline cleaning agent in comparison to the first alkaline cleaning agent. The second alkaline cleaning agent (e.g., mildly alkaline cleaning agent) assists in the cleaning performed by the first alkaline cleaning agent (e.g., strongly alkaline cleaning agent) by a similar mechanism. In accordance with certain embodiments of the invention and as noted above, a first 1% solution of the first alkaline cleaning agent at 20° C. has a first pH value and a second 1% solution of the second alkaline cleaning agent at 20° C. has a second pH, in which the first pH is larger than the second pH. In accordance with certain embodiments of the invention the second alkaline cleaning agent may comprise a carbonate-containing compound or species (e.g., a carbonate salt), such as sodium carbonate and/or sodium bicarbonate. For example, a 1% (w/w) aqueous solution of sodium carbonate has a pH of about 11.4 and a 1% (w/w) aqueous solution of sodium bicarbonate has a pH of about 8.4. Both of these pH values are below that of a 1% (w/w) aqueous solution of sodium metasilicate pentahydrate, which has a pH of about 12.5. In accordance with certain embodiments of the invention, the second alkaline cleaning agent (e.g., sodium carbonate) may be more readily soluble in the aqueous fountain solution than the first alkaline cleaning agent (e.g., strongly alkaline cleaning agent), and is less foamy a material. Consequently, by blending a low concentration of the high pH first alkaline cleaning agent (e.g., a metasilicate) relative to the concentration of the second alkaline cleaning agent (e.g., mildly alkaline cleaning agent) and a higher concentration of the lower pH second alkaline cleaning agent (e.g., a carbonate cleaning agent) relative to the concentration the first alkaline cleaning agent, faster solubility is achieved, undesirable adsorption of undissolved detergent is avoided, and negligible foam (e.g., foam formation at the surface of the fountain solution and extending outwardly into the local environment and/or tank head) levels are encountered in use, without compromising cleaning efficiency. In accordance with certain embodiments of the invention, combination of a pH 11 to 13 cleaner with a pH 10 to 11 cleaner, may result in a pH in the range of 10 to 12 when added to the spent fountain solution, and is sufficiently alkaline a detergent to clean the recirculation system. Also the use of a defoaming additive, with its inherent tendency to adhere to the sides of the recirculation system, is avoided. In this regard, the cleaning systems may be devoid of a defoaming additive in accordance with certain embodiments of the invention.

The first composition, in accordance with certain embodiments of the invention, comprises a cleaning-agent-ratio (CAR), based on weight, between the second cleaning agent and the first cleaning agent from about 3:1 to about 9:1, such as at least about any of the following: 3:1, 3.5:1, 4:1, 4.5:1, 5:1, 5.5:1, and 6:1 and/or at most about 9:1, 8.5:1, 8:1, 7.5:1, 7:1, 6.5:1, 6:1, 5.5:1, 5:1 and 4.5:1. In this regard and as noted above, the concentration of the second alkaline cleaning agent (e.g., mildly alkaline cleaning agent) is greater than that of the first alkaline cleaning agent (e.g., strongly alkaline cleaning agent).

As noted above, the second alkaline cleaning agent may be considered a mildly alkaline cleaning agent in comparison to the first alkaline cleaning agent. In accordance with certain embodiments of the invention, for example, the first alkaline cleaning agent has a first buffer capacity and the second alkaline cleaning agent has a second buffer capacity, in which the first buffer capacity is greater than the second buffer capacity.

In accordance with certain embodiments of the invention, the use of a carbonate salt, such as sodium carbonate, as the second alkaline cleaning agent provides an additional function and/or benefit that is believed to be unique to cleaning systems and methods of cleaning printing press recirculation systems. In addition to functioning as a cleaner at the outset upon being added into the recirculation system and recirculation throughout the recirculation system, the use of a carbonate salt, such as sodium carbonate, as the second alkaline cleaning agent reacts with the acid from the second composition to provide a release (e.g., a controlled release) of carbon dioxide bubbles throughout the recirculation system. As noted throughout, the first composition may be added to the recirculation system, recirculated, and the second composition may be subsequently added to the recirculation system to allow the reaction between the second alkaline cleaning agent (e.g., carbonate salt) and the acid (e.g., one or more organic acids) present in the second composition for produce a plurality of separate and distinct bubbles of carbon dioxide. In this regard, the release of the bubbles serves to dislodge soil, calcium, and emulsified ink from the walls and hard-to-clean lines of the recirculation system. In this regard, the bubble formation further enhances the cleaning effect of the cleaning system, while making it easier for the contamination to be flushed out. In accordance with certain embodiments of the invention, the first and/or second compositions may be selected and/or structured for the generation of other gasses besides carbon dioxide. By the choice of detergent salts used, for example, oxygen, chlorine and similar gasses can be generated to enhance the cleaning. The generation of carbon dioxide provides a particularly desirable gas in view of at least safety reasons, even though other gasses can be used.

In accordance with certain embodiments of the invention, the first composition comprises a solid and/or dry material. For example, the first composition may comprise a solid blend of the individual ingredients of the first composition, such as in a dry blended powdered form or a compacted tablet form. In this regard, the first composition may be directly added into the recirculation system in a solid and/or dry state without performing a pre-dissolving step prior to addition into the recirculation system.

In accordance with certain embodiments of the invention, second composition may be provided in a liquid or a solid and/or dry form. For example, the second composition may comprise a solid and/or dry material. The second composition, for instance, may comprise a solid blend of the individual ingredients of the second composition, such as in a dry blended powdered form or a compacted tablet form. In this regard, the second composition may be directly added into the recirculation system in a solid and/or dry state without performing a pre-dissolving step prior to addition into the recirculation system. In accordance with certain embodiments of the invention, both the first composition and the second composition are dry blended powdered compositions that are configured for direct addition into the recirculation system.

As noted above, the second composition (e.g., dry blended powdered form, tablet form, etc.) may comprise one or more organic acids (e.g., one or more organic acids in dry form). In accordance with certain embodiments of the invention, the second composition comprises one or more organic acids that function to re-acidify the fountain solution containing the cleaning agents of the first composition, such as after the first composition has been recirculated throughout and cleaned the recirculation system to thereby prevent cleaner residue from contaminating the replacement or fresh fountain solution added to the recirculation system after the old, contaminated fountain solution is drained and flushed. As noted above, the pH of the fountain solution, which is typically between 3.5 and 5.5, may rise to approximately 10 to 11 after the first composition is added thereto. Thus, the second composition acts to lower the pH back to, for example, the 3.5 to 5.5 range. Although the particular acid or acids may not be particularly limited in accordance with certain embodiments of the invention, the use of organic acids has been found be particularly suitable for this application. In accordance with certain embodiments of the invention, for instance, any suitable powdered, non-corrosive acid may additionally or alternatively be employed to bring about the neutralization. The one or more organic acids, for example, may comprise citric acid, malic acid, succinic acid, glycolic acid, and combinations thereof. In accordance with certain embodiments of the invention, the second composition comprises a blend of at least two organic acids, wherein at least one the organic acids comprises a polycarboxylic acid. In accordance with certain embodiments of the invention, the second composition comprises a combination of citric acid and malic acid. The second composition, according to certain embodiments of the invention, comprises an acid-ratio (AR), based on weight, between the citric acid to the malic acid comprising from about 5:1 to about 1:5, such as at least about any of the following: 1:5, 1:4.5, 1:4, 1:3.5, 1:3, 1:2.5, 1:2, 1:1.5, and 1:1 and/or at most about 5:1, 4.5.1, 4:1, 3.5:1, 3:1, 2.5:1, 2:1, 1.5:1, and 1:1.

In addition to neutralization of the alkaline detergents of the first composition, the function of the one or more acids of the second composition also reacts with, for example, the carbonate-containing cleaning agent of the first composition to generate a plurality of carbon dioxide bubbles within the recirculation system. By way of example only, the combination of citric acid and malic acid was found to easily result in a neutralization of the fountain solution to an appropriate pH level suitable for a fountain solution recirculation system. In this regard, citric acid is readily available, and being a triprotic acid, needs a smaller amount to bring about the required neutralization. Malic acid is also readily available and although being monoprotic, requiring larger quantities, has the advantage of dissolving and keeping in suspension insoluble calcium salts that accumulate in the recirculation system from paper and ink during printing. Therefore, the blend of acids, in accordance with certain embodiments of the invention, may be chosen in order to neutralize the fountain solution containing the alkaline cleaning agents in such a manner that one or more the following are realized: (i) a large number of carbon dioxide bubbles is generated; (ii) the smallest amount of material is used for neutralization; and (iii) the accumulation of insoluble calcium salts are readily dissolved and flushed out of the recirculating system.

In accordance with certain embodiments of the invention, the rate of carbon dioxide bubble generation varies according to the size and make-up of the recirculating system being cleaned. Since there is a wide variety of recirculating systems with different capacities and configurations, the rate of bubble generation is best determined by observation as the second composition is being added into the recirculation system. For example, too fast of an addition may result in rapid generation of the bubbles that could lead to overflow in the recirculation tank and too slow of an addition does not give the bubbles sufficient time to travel through the lines of the recirculation system. It should be noted that a recirculating system has a tendency of generating some foam that can be seen as persistent air bubbles on the surface of the recirculating liquid. Such foam bubbles, however, have no cleaning function whatsoever and can be a nuisance in the tank if excessive. Therefore, it is particularly desired that the cleaning system does not contribute to any undesirable foaminess. The generation of carbon dioxide bubbles, as discussed herein, is not foam, and can be readily distinguished from foam easily by appearance. In this regard, foam is air bubbles trapped in a liquid interface, is persistent, and does not build up pressure in a confined space as within the lines of the recirculating system. To the contrary, the gas bubbles generated by the addition of the second composition are temporary bubbles that will dissipate as the bubbles naturally burst and build up a slight pressure within the recirculating lines. Besides the cleaning effect of the first composition, the aforementioned pressure build-up by the bubble generation due to the addition of the second composition enhances the cleaning by dislodging the contamination that may be adhered to surfaces within the recirculation system.

In accordance with certain embodiments of the invention, the second composition may further comprise a preservative (e.g., a powdered preservative) that functions as a mild biocide/disinfectant. One non-limiting example includes sodium benzoate, which is non-hazardous in nature and suitable for food grade applications. In this regard, however a variety of powdered biocides may be used. Since, spent fountain solution contains significant amounts of mold and fungal growth, the inclusion of a preservative makes these microorganisms easier to be dislodged and flushed out of the system. In accordance with certain embodiments of the invention, the second composition comprises from about 0.1 to about 10% by weight of the preservative (e.g., powdered preservative).

In another aspect, the present disclosure provides methods of cleaning a printing press recirculation system, in which the recirculation system includes a recirculation tank and a plurality of recirculation lines with a fountain solution contained within the recirculation system. In accordance with certain embodiments of the invention, the methods of cleaning a printing press recirculation system may comprise the following steps: (i) administering a first composition, such as any of the first compositions disclosed herein, into the printing press recirculation system, wherein the first composition comprises an alkaline composition; (ii) recirculating the fountain solution through the printing press recirculation system subsequently and/or concurrently with step (i); (iii) administering a second composition, such as any of the second compositions disclosed herein, comprising at least one acid into the printing press recirculation system in an amount sufficient to form an acidic fountain solution subsequent to step (ii); (iv) recirculating the acid fountain solution subsequently and/or concurrently with step (iii); and (v) allowing the first composition and second composition to react and form a plurality of bubbles within the resulting acidic fountain solution. In accordance with certain embodiments of the invention, the methods of cleaning a printing press recirculation system may comprise administration of any of the cleaning systems (e.g., first composition followed by a second composition) described and disclosed herein. In accordance with certain embodiments of the invention, the methods may further comprise a step of draining the printing press recirculation system after a sufficient period of time as discussed below. Methods may also include a step of flushing the printing press recirculation system with a flushing fluid, such as water, after the spent fountain solution has been drained from the recirculation system.

In accordance with certain embodiments of the invention, the step of recirculating the fountain solution after or during addition of the first composition and prior to addition of the second composition is conducted for a sufficient period of time to clean and loosen at least a majority of contamination within the recirculation system. For example, the sufficient period of time to clean and loosen at least a majority (e.g., at least 50%, 70%, 85%, 90%, 95%, or 99%) of contamination within the printing press recirculation system comprises from about 5 to about 120 minutes, such as from at least about any of the following: 5, 10, 15, 20, 25, and 30 minutes and/or at most about 120, 100, 80, 60, 50, 40, 30, and 20 minutes. In accordance with certain embodiments of the invention the step of administering the first composition into the printing press recirculation system comprises adding the first composition directly into the recirculation tank.

In accordance with certain embodiments of the invention, the step of administering the second composition comprises adding the second composition directly into the recirculation tank, such as in a controlled manner. For example, the step of administering the second composition may comprise a controlled-addition of the second composition over a second period of time, in which the controlled-addition of the second composition over the second period of time at least includes at least a first addition of a first portion of the second composition being added at a first addition time and at least a second addition of a second portion of the second composition being added at a second addition time. For instance, the addition of the second composition may not occur at a single point in time but spread over the course of the second time period in accordance with certain embodiments of the invention. Alternatively, the entirety of the second composition may be added into the recirculation system all at once.

In accordance with certain embodiments of the invention, the step of allowing the first composition and second composition to react and form the plurality of bubbles within the fountain solution occurs within the recirculation tank, the plurality of recirculation lines, or both. In this regard, the controlled-addition of the second composition into the recirculation system over a given period of time (e.g., second period of time discussed above) facilitates formation of the bubbles within both the recirculation tank and the recirculation lines.

In accordance with certain embodiments of the invention, the acidic fountain solution, which is formed by the addition of the second composition, including the plurality of bubbles are recirculated through the printing press recirculation system for about 1 to about 60 minutes, such as from at least about any of the following: 1, 3, 5, 8, 10, 12, 15, 20, 25, and 30 minutes and/or at most about 60, 50, 40, 30, 20, and 15 minutes.

Although the amount of the first composition and the second composition may be varied depending on the size of the recirculation system and/or volume of fountain solution within the recirculation system, the step of administering the first composition into the printing press recirculation system may comprise, in accordance with certain embodiments of the invention, adding from about 20 to about 100 grams of the first composition per gallon of fountain solution present in the printing press recirculation system or recirculation tank, such as from at least about any of the following: 20, 25, 30, 35, 40, 45, 50, 55, 60, 65, and 70 grams of the first composition per gallon of fountain solution present in the printing press recirculation system or recirculation tank and/or at most about 100, 95, 90, 85, 80, 75, 70, 65, 60, 55, and 50 grams of the first composition per gallon of fountain solution present in the printing press recirculation system or recirculation tank. In accordance with certain embodiments of the invention, the step of administering the second composition into the printing press recirculation system may comprise adding from about 20 to about 100 grams of the second composition per gallon of fountain solution present in the printing press recirculation system or recirculation tank, such as from at least about any of the following: 20, 25, 30, 35, 40, 45, 50, 55, 60, 65, and 70 grams of the second composition per gallon of fountain solution present in the printing press recirculation system or recirculation tank and/or at most about 100, 95, 90, 85, 80, 75, 70, 65, 60, 55, and 50 grams of the second composition per gallon of fountain solution present in the printing press recirculation system or recirculation tank.

By way of yet an additional example, the methods of cleaning a printing press recirculation system may comprise adding, for example, 20 to eighty 80 grams of the first composition, which may be in a powder form, by pouring the powdered first composition directly into the recirculation system for each gallon of contaminated dampening fountain solution and allowing the contents to recirculate for at least 30 minutes. Subsequently to recirculation for at least 30 minutes, 20 to eighty 80 grams of the second composition, which may be in powdered form, may then be added as a powder directly into the recirculation system and the recirculation system is run (e.g., contents within the recirculation system are recirculated) for at least an additional 15 minutes. The addition of the second composition may be done slowly and in a controlled manner to allow the gradual neutralization of the alkaline fountain solution (e.g., fountain solution including the first composition comprising alkaline cleaning agents has a basic pH) and control the generation of bubbles (e.g., carbon dioxide bubbles) throughout the entire recirculation system. The recirculation system may then be drained, flushed with clean water, and refilled with fresh fountain solution.

It should be appreciated that the cleaning systems of the present disclosure may be embodied in a wide range of operable formulations as illustrated, at least, by the examples below. In accordance with certain embodiments of the invention, the first and second compositions may be provided in solid or powder form, as well as being configured in a manner to added directly to the recirculation system (e.g., the recirculation tank) without the need for pre-dissolution. However, pre-dissolving the first and/or second compositions (e.g., powdered compositions) separately in water before addition can also be utilized if so desired.

EXAMPLES

The present disclosure is further illustrated by the following examples, which in no way should be construed as being limiting. That is, the specific features described in the following examples are merely illustrative and not limiting.

Dry mixtures (e.g., powdered blend) of four different first compositions (e.g., alkaline composition) were formed and each was separately added to a contaminated fountain solution of a five-gallon recirculation system of a 26" Ryobi 460K printing press to independently evaluate each cleaning composition. The four different first compositions (i.e., EX 1, EX 2, EX 3, and EX 4) are summarized in Table 1 below.

TABLE 1

First Compositions (e.g., alkaline composition)

| INGREDIENT | EX 1 | EX 2 | EX 3 | EX 4 |
|---|---|---|---|---|
| Sodium Metasilicate.5H20 | 83.3 grams | 50 grams | 33.3 grams | 16.6 grams |
| Sodium Tripolyphosphate | 83.3 grams | 50 grams | 33.3 grams | 16.6 grams |
| SXS 93% Powder | 83.3 grams | 50 grams | 33.3 grams | 16.6 grams |
| Sodium Carbonate | 0 grams | 100 grams | 150 grams | 200 grams |

Additionally, dry mixtures (e.g., powdered blend) of three different second compositions (e.g., acid compositions) were formed and each was added to the recirculation system after the addition of the different first compositions in accordance with certain embodiments of the invention described herein. The three different second compositions (i.e., 2-EX 1, 2-EX 2, and 2-EX 3) are summarized in Table 2 below.

TABLE 2

Second Compositions (e.g., acid composition)

| INGREDIENT | 2-EX 1 | 2-EX 2 | 2-EX 3 |
|---|---|---|---|
| CITRIC ACID | 250.0 grams | 124.5 grams | 0.0 grams |
| MALIC ACID | 0.0 grams | 124.5 grams | 250.0 grams |
| SODIUM BENZOATE | 0.0 grams | 1.0 gram | 0.0 grams |

To evaluate the performance of cleaning systems using different first compositions and/or second compositions, a first composition was added to the recirculation tank of the recirculation system containing the contaminated fountain solution and allowed to recirculate for 30 minutes. After recirculation for 30 minutes, a second composition was added in a controlled manner (e.g., the amount of the second composition was added slowly and not all at once) to ensure that the generation of the carbon dioxide bubbles occurred throughout the recirculation system (e.g., the recirculation tank and the recirculation pipes) and were not generated so quickly as to initiate an overflow of the recirculation tank. After all of the second composition was added, the resulting acidic fountain solution including the plurality of formed bubbles was allowed to recirculate for an additional 15 minutes.

The cleaning ability of each of these cleaning systems (e.g., the different combinations of the first compositions and the second compositions) was compared to a liquid cleaner (Allied Dampening Systems Cleaner), and to a powdered 2-Step cleaner (Allied Powdered Systems Cleaner Step 1 and Step 2).

Variations to the first compositions (summarized in Table 1):

The sodium carbonate was deliberately left out of Example 1 to judge the effect of high concentrations of the high pH sodium metasilicate. Complete dissolution did not occur and there was more foam that could be tolerated by the system. In Example 2, the level of sodium carbonate was increased and the amount of the sodium metasilicate was slightly reduced. The first composition of Example 2 appeared to include an amount of sodium carbonate that was too low and only resulted in minor amount carbon dioxide generation and failed to dislodge all contamination of the walls of the system upon reaction with the second compositions. The first composition of Example 3, which worked best, included an increased amount of sodium carbonate as compared to the first composition of Example 2 and a reduced amount sodium metasilicate as compared to the first composition of Example 2. The first composition of Example 4 included an increased amount of sodium carbonate as compared to the first composition of Example 3 and a reduced amount sodium metasilicate as compared to the first composition of Example 3. The first composition of Example 4 appeared to have too high a concentration of the sodium carbonate as an increased amount of the second compositions was need to neutralize the fountain solution (more of Step 2 was needed to neutralize) and too low a level to sodium metasilicate for sufficient cleaning, at least, with respect to the results realized by the use of the first composition of Example 3. In this regard, the first composition of Example 3 provided the best results with each of the second compositions, even though all variations resulted in a cleaner recirculation system.

Variations to the second compositions (summarized in Table 2):

It was intended that the total amount of a second composition used be the same as the total amount of the first composition for convenience and ease of measurement and packaging, though this is not necessary. The second composition of 2-Example 1 was all citric acid and brought about a lower pH in the neutralized fountain solution than was desired. Another deficiency noted was the all of the calcium deposits that could be seen adhering on to walls of the recirculation system were not dissolved by this acid. The second composition of S-Example 2 provided the most desirable level of neutralization together while still allowing the complete removal of the calcium deposits. A small concentration of a preservative, sodium benzoate, was incorporated into the second composition of 2-Example 2 to assist in the removal of mold and fungi. The second composition of 2-Example 3 provided a complete removal of the observed calcium deposits, but the final pH of the neutralized fountain solution was higher than desired.

Therefore, combination of the first composition from Example 1 and the second composition from 2-Example 2 provided the most desirable balance of cleaning efficiency, ease of dispersal, and carbon dioxide bubble generation. In this regard, the cleaning system comprising the first composition from Example 1 and the second composition from 2-Example 2 provided a vigorous, but controlled, release of carbon dioxide bubbles throughout the entire recirculation system, which further enhanced the cleaning process by dislodging both soil and calcium deposits that are found not only on the walls of the tank of the recirculating system, but also on the walls of the recirculation lines that lead directly to the printing press which cannot be seen. It should be noted that these areas (e.g., the recirculation lines) are normally difficult to clean, and if left untreated, leads to contamination of the fresh fountain solution, and eventual restriction of the fountain solution flow within the recirculation lines.

These and other modifications and variations to the invention may be practiced by those of ordinary skill in the art without departing from the spirit and scope of the invention, which is more particularly set forth in the appended claims. In addition, it should be understood that aspects of the various embodiments may be interchanged in whole or in part. Furthermore, those of ordinary skill in the art will appreciate that the foregoing description is by way of example only, and it is not intended to limit the invention as further described in such appended claims. Therefore, the spirit and scope of the appended claims should not be limited to the exemplary description of the versions contained herein.

That which is claimed:

1. A cleaning system, comprising:

(i) a first composition comprising a solid blend including (a) a first alkaline cleaning agent comprising a silicate compound and having a first alkaline strength, (b) a detergent salt, (c) a non-foaming emulsifying agent comprising an anionic surfactant, and (d) a second alkaline cleaning agent comprising a carbonate salt and having a second alkaline strength; wherein the first alkaline strength is greater than the second alkaline strength; and (ii) a second composition comprising one or more organic acids.

2. The cleaning system of claim 1, wherein the first composition comprises one or more of the following (1) from about 1 to about 50 weight percent of the first alkaline cleaning agent; (2) from about 1 to about 50 weight percent of the detergent salt; (3) from about 1 to about 50 weight percent of the non-foaming emulsifying agent; and from about 20 to about 85 weight percent of the second alkaline cleaning agent.

3. The cleaning system of claim 1, wherein the silicate compound is a sodium metasilicate.

4. The cleaning system of claim 1, wherein a first 1% solution of the first alkaline cleaning agent at 20° C. has a first pH value and a second 1% solution of the second alkaline cleaning agent at 20° C. has a second pH; wherein the first pH is larger than the second pH.

5. The cleaning system of claim 4, wherein the first pH is from 11-14.

6. The cleaning system of claim 1, wherein the first alkaline cleaning agent has a first buffer capacity and the second alkaline cleaning agent has a second buffer capacity; wherein the first buffer capacity is greater than the second buffer capacity.

7. The cleaning system of claim 1, wherein the first composition comprises a cleaning-agent-ratio (CAR), based on weight, between the second alkaline cleaning agent and the first alkaline cleaning agent from about 3:1 to about 9:1.

8. The cleaning system of claim 1, wherein the second alkaline cleaning agent comprises sodium carbonate, the detergent salt comprises a phosphate salt, and the anionic surfactant comprises an alkylaryl sulfonate.

9. The cleaning system of claim 1, wherein the solid blend comprises a powdered form.

10. The cleaning system of claim 1, wherein the one or more organic acids comprise citric acid, malic acid, succinic acid, glycolic acid, and combinations thereof.

11. The cleaning system of claim 1, wherein the second composition comprises a blend of at least two organic acids; wherein at least one the organic acids comprises a polycarboxylic acid.

12. The cleaning system of claim 1, wherein the one or more organic acids comprises a combination of citric acid and malic acid.

13. The cleaning system of claim 12, wherein the second composition comprises an acid-ratio (AR), based on weight, between the citric acid to the malic acid comprising from about 5:1 to about 1:5.

14. The cleaning system of claim 1, wherein the second composition further comprises from about 0.1 to about 10% by weight of a powdered preservative.

15. A cleaning system, comprising:

(i) a first composition comprising a solid blend including (a) a first alkaline cleaning agent having a first alkaline strength, the first alkaline cleaning agent comprising sodium metasilicate pentahydrate, (b) a detergent salt comprising sodium tripolyphosphate, (c) a non-foaming emulsifying agent comprising sodium xylene sulfonate, and (d) a second alkaline cleaning agent having a second alkaline strength, the second alkaline cleaning agent comprising sodium carbonate; wherein the first alkaline strength is greater than the second alkaline strength; and (ii) a second composition comprising a plurality of organic acids comprising malic acid and citric acid.

16. The cleaning system of claim 15, wherein the second composition comprises an acid-ratio, based on weight, between the citric acid and the malic acid from 5:1 to 1:5.

17. The cleaning system of claim 15, wherein the second composition comprises an acid-ratio, based on weight, between the citric acid and the malic acid from 2:1 to 1:2.

18. The cleaning system of claim 15, wherein the second composition comprises an acid-ratio, based on weight, between the citric acid and the malic acid of 1:1.

19. The cleaning system of claim 15, wherein the first composition comprises a cleaning-agent-ratio, based on weight, between the second alkaline cleaning agent and the first alkaline cleaning agent from about 3:1 to about 6:1.

20. The cleaning system of claim 15, wherein the first composition comprises a cleaning-agent-ratio, based on weight, between the second alkaline cleaning agent and the first alkaline cleaning agent from about 4:1 to about 5:1.

* * * * *